United States Patent [19]

Benstein et al.

[11] 4,431,374

[45] Feb. 14, 1984

[54] VORTEX CONTROLLED RADIAL DIFFUSER FOR CENTRIFUGAL COMPRESSOR

[75] Inventors: Eli H. Benstein, Toledo; Gerald D. Stringham, Sylvania, both of Ohio; Michael R. Holbrook, Lambertville, Mich.

[73] Assignee: Teledyne Industries, Inc., Los Angeles, Calif.

[21] Appl. No.: 236,649

[22] Filed: Feb. 23, 1981

[51] Int. Cl.[3] ..... F04D 29/44

[52] U.S. Cl. ..... 415/211; 415/DIG. 1

[58] Field of Search ..... 415/207, 211, DIG. 1

[56] References Cited

U.S. PATENT DOCUMENTS

| | | | |
|---|---|---|---|
| 3,460,748 | 8/1969 | Erwin . | |
| 3,524,458 | 8/1970 | Goldsmith | 137/15.1 |
| 3,658,437 | 4/1972 | Soo . | |
| 3,771,925 | 11/1973 | Friberg et al. . | |
| 3,788,635 | 1/1974 | Rusak . | |
| 3,788,765 | 1/1974 | Rusak | 415/213 |
| 3,868,195 | 2/1975 | Lown . | |
| 3,868,196 | 2/1975 | Lown | 415/146 |
| 3,941,501 | 3/1976 | Shank . | |
| 4,214,452 | 7/1980 | Riollet et al. | 60/697 |
| 4,308,718 | 1/1982 | Mowill | 60/39.02 |

FOREIGN PATENT DOCUMENTS

| | | | |
|---|---|---|---|
| 659211 | 8/1936 | Fed. Rep. of Germany | 415/211 |

*Primary Examiner*—Harvey C. Hornsby
*Assistant Examiner*—Brian Bowman
*Attorney, Agent, or Firm*—Gifford, Van Ophem, Sheridan & Sprinkle

[57] ABSTRACT

The present invention is an improvement in radial diffusers employed in a turbine engine having a centrifugal compressor. The walls of the diffuser define at least one flow passage through the diffuser having a first portion with a first cross-sectional area and a second portion having a larger, second cross-sectional area. The first wall section is spaced apart from the second wall section so as to define a bleed aperture therebetween. A vortex fence extends outwardly from the wall surface at the leading edge of the second wall portion. Preferably, the bleed aperture and the vortex fence are disposed on the suction surface of each vane in a vaned radial diffuser.

7 Claims, 4 Drawing Figures

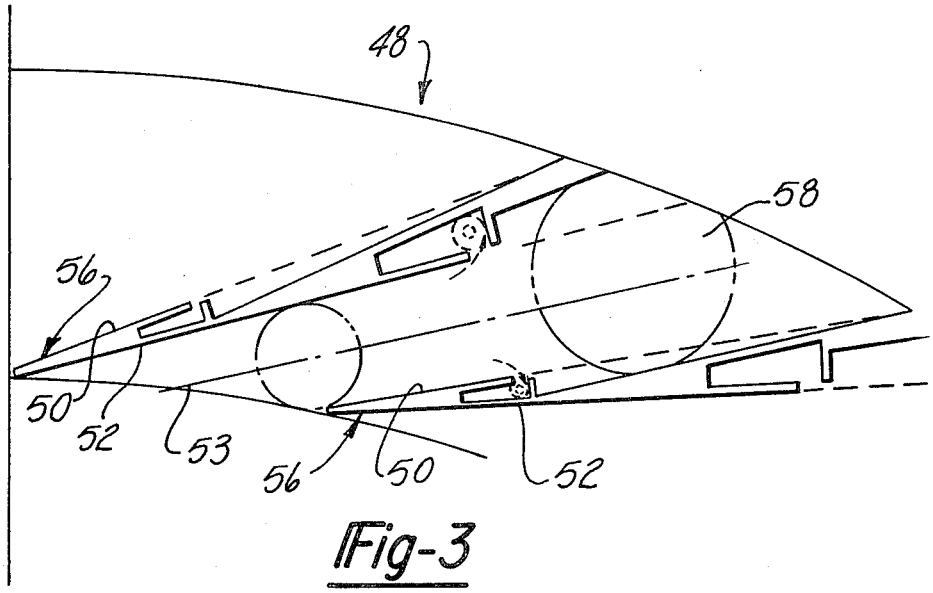
Fig-3
Fig-4
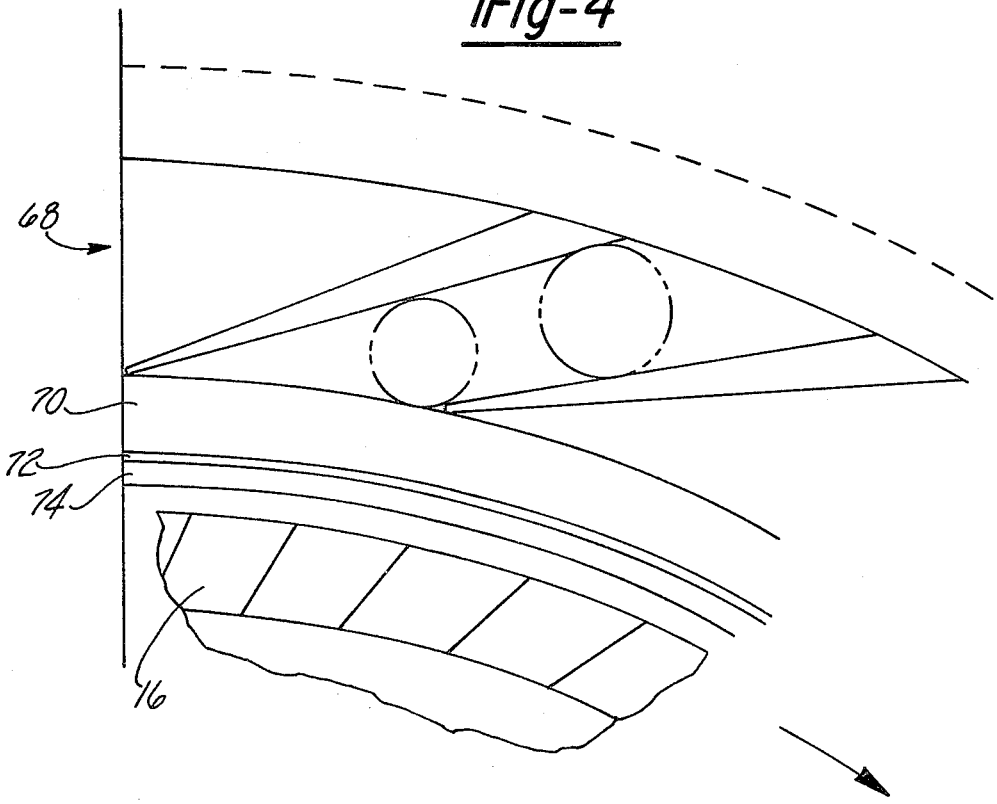

VORTEX CONTROLLED RADIAL DIFFUSER FOR CENTRIFUGAL COMPRESSOR

BACKGROUND OF THE INVENTION

I. Field of the Invention

The present invention relates generally to radial diffusers for a centrifugal compressor in a turbine engine, and more particularly, to a radial diffuser in which the vanes of the diffuser include a vortex fence to improve the efficiency of the diffuser.

II. Description of the Prior Art

The diffuser of a turbine engine distributes the pressurized gas flow from the turbine compressor to the combustor of the turbine. It is important that the diffuser obtains a high static pressure recovery and that the high velocity energy head produced by the compressor impeller is preserved from the pressure losses due to friction so that the total pressure of the gas is maximized as it reaches the combustor. As the total pressure recovery from these two pressure components increases, the efficiency of the turbine engine is increased.

One previously known device for obtaining a high static pressure recovery from the static energy and kinetic energy of the gases and for obtaining higher rates of diffusion is a vortex controlled diffuser. The vortex control concept has been studied when applied to the axial flow of gas from a first primary duct to a second coaxial and enlarged secondary duct. A radially extending vortex fence secured to the inner periphery of the secondary duct is axially spaced and radially spaced from the outlet end of the primary duct. A flow chamber upstream of the vortex fence forms a bleed mechanism that creates a vortex used to energize flow in the wake region immediately downstream of the diffusing step, whereby flow attachment on the diffusing roll of the secondary duct is enhanced. Low momentum fluid is removed from the upstream wall of the vortex fence and the corner vortex formed at the downstream end of the fence smooths flow transition to the downstream wall. The vortex control concept has been successfully applied to annular precombustor diffusers as has been reported by A. J. Verdouw in "Performance of the Vortex Controlled Diffuser (VCD) In an Annular Combustor Flow Path" in the AIAA Tech Info. Service Report A78-50574, March 1978, in R. C. Adkins and J. O. Yost's "A Combined Diffuser Arrangement" Technion-Israel Inst. of Tech. (Haifa), July 1979 and by John M. Smith in "Performance of a Vortex Controlled Diffuser in an Annular Swirl-Can Combustor at Inlet Mach Numbers up to 0.53", NASA Tech. Paper 1452, 1979. Nevertheless, the vortex controlled concept has not been previously found applicable to radial diffusers employed downstream of centrifugal compressors.

Previously known diffusers for centrifugal compressors have employed structural configurations of the vanes unrelated to the VCD concept in order to improve pressure recovery of the diffuser. For instance, the U.S. Pat. No. 3,788,765 to Rusak discloses wedge-type vanes having increasing thickness from inlet to exit wherein the pressure side of the vanes at the exit are streamlined to reduce the exit wake losses. The vanes include an extension at the trailing side of the exit vane to follow the shape of the streamlined pressure side of the following vane for better control of the channel exit area and the direction of flow. U.S. Pat. No. 3,658,437 to Soo discloses a diffuser wherein the opposing end wall surfaces converge and diverge within the vaned diffuser section. The cross section of the diffuser decreases and then increases in a manner suitable for maintaining fluid flow under a condition of imminent boundary layer separation. Although the U.S. Pat. No. 3,868,196 to Lown discloses a centrifugal compressor with a rotating vaneless diffuser in which the impeller establishes vortex flow in the diffuser, the tangential bleed through a clearance space between the impeller and rotating diffuser removes the high velocity leakage flow. Thus, the previously known radial diffusers do not apply the teachings of previously known vortex controlled diffusers where the low momentum fluid is removed at the upstream wall of the vortex fence and the vortex established smooths flow transition to the downstream wall.

SUMMARY OF THE PRESENT INVENTION

The radial diffuser of the present invention overcomes the above mentioned disadvantages by providing a radial diffuser wherein the flow passages defined between the vanes and the diffuser end walls are defined by walls constructed with a vortex fence and bleed mechanism to decrease total pressure losses and increase the pressure recovery of the diffused gases delivered from the centrigual compressor. The diffuser of the present invention also achieves a higher static pressure increase in a shorter flow path (i.e. improved rate of diffusion) than the previously known radial diffusers. Consequently, the diffuser of the present invention permits reduction of the diffuser diameter whereby engine weight and drag area in an aircraft application are reduced. In any event, engine efficiency is improved compared with previously known turbine engines having conventional radial diffusers. Preferably the vortex fence and bleed mechanism are located on the suction surface of the radial vanes where the flowing gases have the lowest flow momentum and the greatest probability of separation. In addition, it has been found that the preferred construction of the radial diffuser permits a reduction in vane exit radius whereby the diffuser can be made more compact while at the same time increasing the efficiency of the diffuser.

BRIEF DESCRIPTION OF THE DRAWING

The present invention will be more clearly understood by reference to the following detailed description of a preferred embodiment of the present invention when read in conjunction with the accompanying drawing wherein like reference characters refer to like parts throughout the separate views, and wherein:

FIG. 3 is a fragmentary sectional view similar to FIG. 2, but showing a modification of the diffuser; and FIG. 4 is a fragmentary sectional view similar to FIGS. 2 and 3, but showing a further modification of the diffuser.

DETAILED DESCRIPTION OF A PREFERRED EMBODIMENT OF THE PRESENT INVENTION

Figure 1:
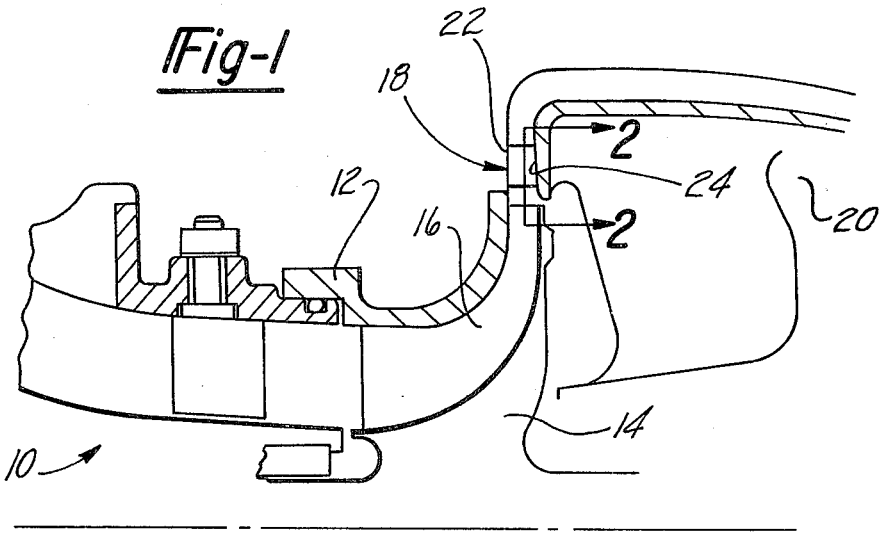
FIG. 1 is a fragmentary sectional view of a turbine engine having a centrifugal compressor and employing the radial diffuser of the present invention.

Referring to FIG. 1, a turbine engine 10 is thereshown comprising a housing 12 having a centrifugal compressor 14 rotatably secured therein. The impeller 16 of the compressor 14 induces gas flow through the radial diffuser 18 toward the combustor 20.

Figure 2:
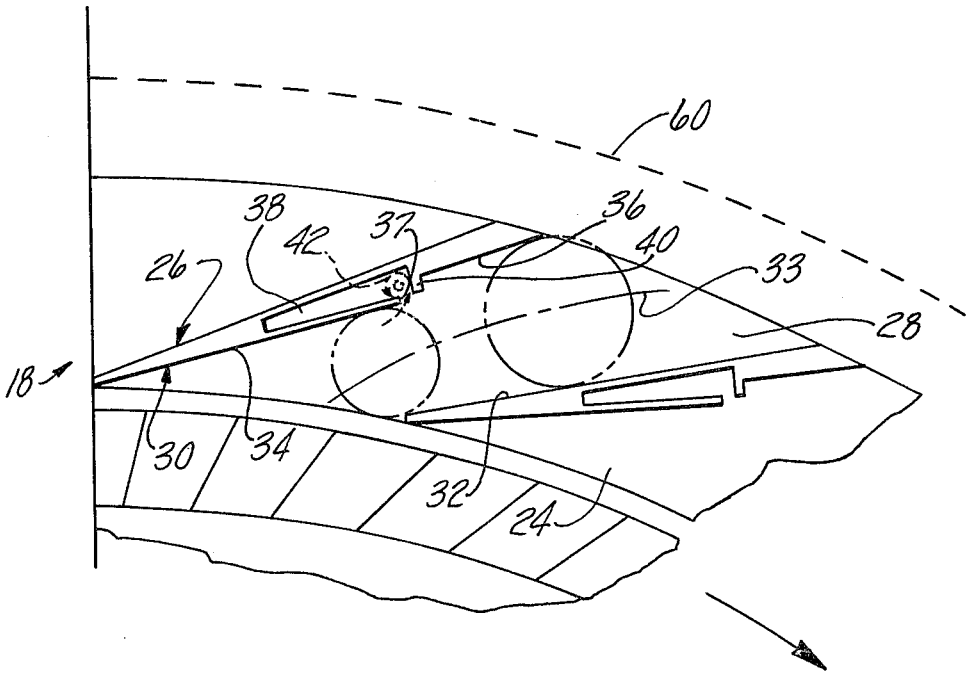
FIG. 2 is a fragmentary sectional view taken substantially along the line 2—2 in FIG. 1.

As best shown in FIG. 2, the radial diffuser 18 of the present invention comprises a ring member having radial end walls 22 and 24 spaced axially apart by a plurality of circumferentially spaced, substantially wedge-shaped vanes 26. The radially inclined vanes 26 are spaced apart so as to define a plurality of diffusing passages 28 intermediate adjacent vanes 26 between the end walls 22 and 24. In particular, each diffuser passage 28 is defined by the suction surface 30 of a first vane member 26 and the pressure surface 32 of the adjacent vane 26 intermediate the end walls 22 and 24. The angle of inclination of the vanes 26 with respect to the radius of the diffuser is defined to take full advantage of the swirl of the gas flow released from the impeller of the centrifugal compressor.

The suction surface 30 of each vane 26 includes a leading edge portion 34 spaced a first predetermined distance from the leading edge of the pressure surface 32 of the adjacent vane 26, and a second trailing edge portion 36 spaced a greater second distance from the pressure surface 32 of the adjacent vane 26. The diffuser passage 28 is therefore divided into an inlet portion having a first cross-sectional area and an exit portion having a larger cross-sectional area. The leading edge of the second surface portion 36 is spaced along the axis 33 of the cascade from the trailing edge of the leading portion 34 so as to define a bleed inlet 37 for the bleed cavity 38 hollowed out between a portion of the leading suction surface portion 34 and the pressure surface 32 of the first vane 26. In addition, the leading edge of the trailing portion 36 of the suction surface 30 includes a vortex fence 40 extending perpendicular to the axis of the cascade which extends slightly less than the height of the trailing edge of the first surface portion 34.

Having thus described the important structural features of the radial diffuser of the present invention, the operation of the preferred embodiment of the diffuser can be easily explained. The impeller blading 16 of the centrifugal compressor 14 forces the gas radially outwardly toward the leading edges of the vanes 26. The gas is forced to flow along the leading portion 34 of the suction surface 30. As gas continues to flow through the channel 28 a portion of the flow along the suction surface 30 is bled through the inlet 37 of the chamber 38 and forms a flow vortex in the chamber as shown diagrammatically at 42 in FIG. 2 beneath the inlet 37. The gas which forms the vortex can be bled from the chamber 38 through appropriate conduits (not shown) in order to cool various parts of the turbine engine. As the remaining gases flow through the passage 28 past the fence 40 and spread toward the second wall portion 36 of suction surface 30, the vortex formed downstream of the fence 40 smooths flow over the fence, reducing the turbulence at the trailing edge of the fence, and also enhances flow attachment to the trailing portion 36 of suction surface 30.

It appears that the above-described structure results in a reduction in discharge velocity and significant increase in pressure recovery. Preliminary analysis suggests that when the bleed mechanism and vortex fence construction are applied to the end walls rather than the suction surface of the vanes, total pressure loss increases. Therefore, construction of these elements on the suction surface of the vanes appears to be desirable in order to produce a marked reduction in total pressure loss. This is probably due to the fact that the gas at the suction surface has the lowest flow momentum and the greatest possibility of separation.

Reduction of the vane exit radius in conjunction with use of the current invention improves the pressure recovery and reduces the total pressure loss as compared to conventional radial vaned diffusers having the same number of vanes, vane incidence and throat size. Consequently, a radial diffuser according to the present invention can be lighter, more compact, and less wasteful of energy than previously known radial diffusers with exit radii as shown at 60 in FIG. 2. Nevertheless, fence height and bleed rate can be varied to provide maximum static pressure recovery with minimal total pressure loss for a radial diffuser having a fixed exit radius and fixed exit to inlet area ratio.

FIG. 3 illustrates a radial diffuser 48 wherein a vortex fence and bleed mechanism are applied to the pressure surface 50 and the suction surface 52 of each vane 56. Thus, each diffusing passage 58 is defined by the two vane surfaces 50, 52 extending along the axis 53 of the cascade, and vortices are established in each wall so that flow attachment along each vane surface 50, 52 is enhanced.

FIG. 4 illustrates a turbine engine construction wherein the vortex-controlled diffuser concept is applied to a turbine engine utilizing a conventional radial diffuser 68. The vortex fence 72 and bleed mechanism 74 is constructed between the tips of the impeller 16 and the diffuser 68 in the housing walls defining flow passage 70.

Having thus described our invention, many modifications will become apparent to those skilled in the pertinent art without departing from the scope and the spirit of the present invention as defined in the appended claims.

What is claimed is:

1. In combination with a turbine engine having a centrifugal compressor and a radial diffuser disposed in the flow path of the output from the centrifugal compressor, the improvement comprising:

at least one wall defining at least a portion of a flow path through said diffuser, said wall having a first portion defining one side of a flow passage having a first cross-sectional area, and a second portion defining one side of a flow passage having a larger, second cross-sectional area, said second portion being spaced apart from said first portion so as to define a bleed aperture intermediate said first and second portion, and wherein the leading edge of said second portion includes a third wall portion extending outwardly from said second portion.

2. The invention as defined in claim 1 wherein said radial diffuser includes a plurality of radially inclined and spaced vanes.

3. The invention as defined in claim 2 wherein at least one said wall comprises a surface of each vane.

4. The invention as defined in claim 3 wherein each said vane includes a hollow portion defining a vortex chamber beneath said bleed aperture.

5. The invention as defined in claim 3 wherein said surface is the suction surface of said vane.

6. The invention as defined in claim 2 wherein said at least one wall comprises an end wall of said radial diffuser.

7. The invention as defined in claim 1 wherein the height of said third wall portion is less than the height of the trailing edge of said first portion.

* * * * *

UNITED STATES PATENT AND TRADEMARK OFFICE

CERTIFICATE OF CORRECTION

PATENT NO. : 4,431,374

DATED : February 14, 1984

INVENTOR(S) : Eli H. Benstein, Gerald D. Stringham, Michael R. Holbrook

It is certified that error appears in the above—identified patent and that said Letters Patent is hereby corrected as shown below:

Column 2, line 27 delete "centrigual" and insert --centrifugal--.

Signed and Sealed this

*Eighteenth* Day of *December 1984*

[SEAL]

*Attest:*

*Attesting Officer*

GERALD J. MOSSINGHOFF

*Commissioner of Patents and Trademarks*